US006915971B2

(12) United States Patent
Pallmann

(10) Patent No.: US 6,915,971 B2
(45) Date of Patent: Jul. 12, 2005

(54) COMMINUTING UNIT OF A COMMINUTING MACHINE FOR COMMINUTING MATERIAL, ESPECIALLY KNIFE BLOCK FOR A WOOD SLICER

(75) Inventor: Wilhelm Pallmann, Zweibrücken (DE)

(73) Assignee: Pallmann Maschinenfabrik GmbH & Co. KG, Zweibrücken (DE)

( * ) Notice: Subject to any disclaimer, the term of this patent is extended or adjusted under 35 U.S.C. 154(b) by 0 days.

(21) Appl. No.: 10/151,719

(22) Filed: May 18, 2002

(65) Prior Publication Data

US 2002/0170992 A1 Nov. 21, 2002

(30) Foreign Application Priority Data

May 21, 2001 (DE) ..... 101 25 922

(51) Int. Cl.[7] ..... B02C 19/00

(52) U.S. Cl. ..... 241/91; 241/278.2; 144/174; 144/176; 144/235

(58) Field of Search ..... 241/91, 278.2, 241/32, 371; 144/176, 162.1, 172, 174, 230, 235

(56) References Cited

U.S. PATENT DOCUMENTS 3,559,705 A * 2/1971 Salzmann, Jr. ..... 144/162.1
5,139,063 A * 8/1992 Nettles et al. ..... 144/176
5,348,064 A * 9/1994 Nettles et al. ..... 144/176
5,485,873 A * 1/1996 Crammond ..... 144/162.1
5,660,218 A * 8/1997 Jonkka ..... 144/176
5,868,602 A * 2/1999 Pallman ..... 451/10
5,937,923 A * 8/1999 Bielagus et al. ..... 144/172
6,558,237 B1 * 5/2003 Loth et al. ..... 241/278.2
6,561,885 B1 * 5/2003 Loth ..... 451/122

FOREIGN PATENT DOCUMENTS

DE 3205759 1/1983

* cited by examiner

*Primary Examiner*—Derris H. Banks
*Assistant Examiner*—Jimmy T Nguyen
(74) *Attorney, Agent, or Firm*—Friedrich Kueffner

(57) ABSTRACT

A comminuting unit of a comminuting machine for comminuting material has a plurality of knife carriers with a longitudinal axis. The knife carriers are arranged along a comminution path of the comminuting unit and have a leading longitudinal edge. The knife carriers are aligned with the longitudinal axes transversely to the comminution path and parallel to one another. The knife carriers have an axis-parallel slicing knives arranged at the leading longitudinal edge. The slicing knives have a cutting edge extending at a predetermined angle and a predetermined projecting length into the comminution path. Axial passage slots are formed between the knife carriers allowing passage of material comminuted by the slicing knives such that a rearward longitudinal edge of a preceding knife carrier and the slicing knife of the following knife carrier together define the axial passage slot in the form of a guide channel.

7 Claims, 2 Drawing Sheets

COMMINUTING UNIT OF A COMMINUTING MACHINE FOR COMMINUTING MATERIAL, ESPECIALLY KNIFE BLOCK FOR A WOOD SLICER

BACKGROUND OF THE INVENTION

1. Field of the Invention

The invention relates to a comminuting unit of a comminuting machine for comminuting material, in particular, to a knife block of a wood slicer, comprising a plurality of knife carriers arranged along a comminution path. The knife carriers are aligned with their longitudinal axes transversely to the comminution path and parallel to one another. Each knife carrier has an axis-parallel slicing knife at its leading longitudinal edge whose cutting edge extends at a predetermined angle and a predetermined projecting length into the comminution path, wherein the slicing knife of a knife carrier together with the rearward longitudinal edge of the preceding knife carrier defines an axial passage slot in the comminution path.

2. Description of the Related Art

Comminuting units of the aforementioned kind are used, for example, in knife ring slicing devices with a stationary or a rotating knife ring and serve, inter alia, for comminuting wood which may be provided in the form of tree trunks or also in the form of chopped strands. The strands which are produced in this way serve as a starting material for wood-based structural boards, such as, for example oriented strand board (OSB) or particle board.

In the manufacture of particle board as well as oriented strand board (OSB), the strands are wetted with an adhesive, distributed on a support, and pressed to sheet-shaped structural parts by applying heat and pressure. The deciding factor for the strength and economic efficiency of such products is the quality of the strands. The quality is determined primarily by the quality of the cut surfaces. When the cut surfaces are smooth, the surface area of the strands to be wetted is reduced so that less bonding agent (adhesive) is required for bonding the material. Moreover, smooth cut surfaces provide planar contact surfaces during adhesive bonding which leads to an improved connection of the strands with one another and thus results in a higher strength of the finished structural part.

A further factor in regard to the strand quality, which is important primarily in regard to oriented strand board, is the requirement of a uniform geometry. With uniform strand dimensions, it is possible to distribute the strands with almost fiber-parallel alignment so that very high strengths can be obtained in the bearing or loading direction. While the thickness of the strands can be easily produced by means of the projecting length of the cutting edge and the strand length by means of scoring knives, the manufacture of a constant strand width requires a more complex approach.

When removing a strand from the residual wood to be chipped by means of a slicing knife, the cutting edge of the slicing knife penetrates by the projecting length of the cutting edge into the material and slices off a strand of the material like a plane. When doing so, an advancing wedge-shaped tear or crack between the residual wood and the strand being sliced off will result immediately in front of the cutting edge of the slicing knife. A problem in this connection is that the wedge-shaped tear prevents the formation of a smooth cut surface and, according to the shape and the course of the longitudinal fibers of the material, results in roughness of the cut surface. Moreover, an increased amount of bonding agent is required for producing the particle board or oriented strand board. Also, the strength of the produced boards is reduced.

In order to counteract the formation of a wedge-shaped tear and the resulting negative effects, attempts have been undertaken to limit the area of the wedge-shaped tear to the immediate cutting edge area. For example, German patent 32 05 759 C1 describes a slicing device comprising a knife block in which knife carriers with the corresponding slicing knives are arranged in a ring shape. Two sequentially positioned knife carriers form by means of the back of the first knife carrier and the lower longitudinal edge of the leading knife carrier a passage slot for the strand. The rearward edge of the leading knife carrier is also referred to as a pressure lip which exerts a radial pressure acting on the body to be sliced and, in this way, reduces the degree to which formation of a wedge-shaped tear occurs. Still, in this way a tear formation cannot be prevented so that an improvement of the strand surface relative to slicing without pressure lip is achieved; however, the strands which are produced in this way have still a certain roughness at their cut surface which leads to the afore described disadvantages.

A further disadvantage of the passage slots known from the prior art is caused by their constructive configuration. In order to prevent clogging of the passage slot, the passage slot widens extremely behind the pressure lip so that the effect of the passage slot, i.e., providing a passage of a predetermined size, is present only within the plane of the slot. This has the result that upon comminution of small-size material such as, for example, chopped strands, parts of a greater dimension than that of the slot width will be squeezed through the slot which can lead to splintering of the material. On the other hand, it frequently happens that partial pieces that are too large will pass through the slot as a result of the elasticity of the material and the strands manufactured in this way fluctuate greatly with regard to size and shape.

SUMMARY OF THE INVENTION

It is an object of the present invention to develop comminuting units of the aforementioned kind such that the strands produced therewith have a higher quality in comparison to the prior art.

In accordance with the present invention, this is achieved in that the passage slot is in the form of a guide channel.

The basic principle of the invention resides in that by providing a three-dimensional guide channel as the passage slot the strand to be produced is guided and secured in the area behind the cutting edge as well as in the area before the cutting edge.

In contrast to an areal passage slot, a guide channel according to the invention thus provides a three-dimensional securing action for the strand which enables cutting conditions in the cutting edge area controlled to the greatest possible degree. This makes it possible to reduce the advancing rate of the tear constantly with the result that the strands exhibit a smoother surface.

Another advantage of the guide channel according to the invention resides in the possibility of comminuting residual pieces to be comminuted by means of slicing. This is also possible because of the improved securing action of the material to be comminuted during the cutting or slicing process. As a result, fewer splinters are produced during the comminution process and the three-dimensional passage slot provides a more exact separation of the different types of the comminuted material so that a greater purity with regard to type results. Both advantages result in very high-quality strands.

In connection with a strand breaker strip in the area of the knife back, as used, for example, in connection with devices for slicing long-cut wood for generating three-dimensional strands with constant dimensions, the produced strand can be aligned in a targeted way relative to the strand breaker strip so that it is ensured that the strand after reaching a predetermined width is broken and does not pass the strand breaker strip.

According to an advantageous embodiment of the invention, a conical widening of the guide channel in the direction of passage of the strand is also possible to a limited extent in order to ensure removal of the strand. The conical widening however encounters its limits when the securing and guiding capacity of the guide channel is lost. For maintaining the proper guiding and securing conditions, the invention provides a maximum opening angle of 20°. A preferred embodiment has a maximum opening angle of 5°. The guide channel has preferably a smallest width between 1.5 mm and 3 mm; the preferred smallest width is 2.3 mm. The depth of the guide channel in the direction of passage of the strands is preferably 4 mm to 16 mm. In regard to these dimensions of the guide channel, it must be kept in mind that they can vary depending on the type of wood and the moisture contents of the wood as well as the circumferential speed of the cutting tool and the set angle of the slicing knives.

DESCRIPTION OF THE PREFERRED EMBODIMENTS

Figure 1:
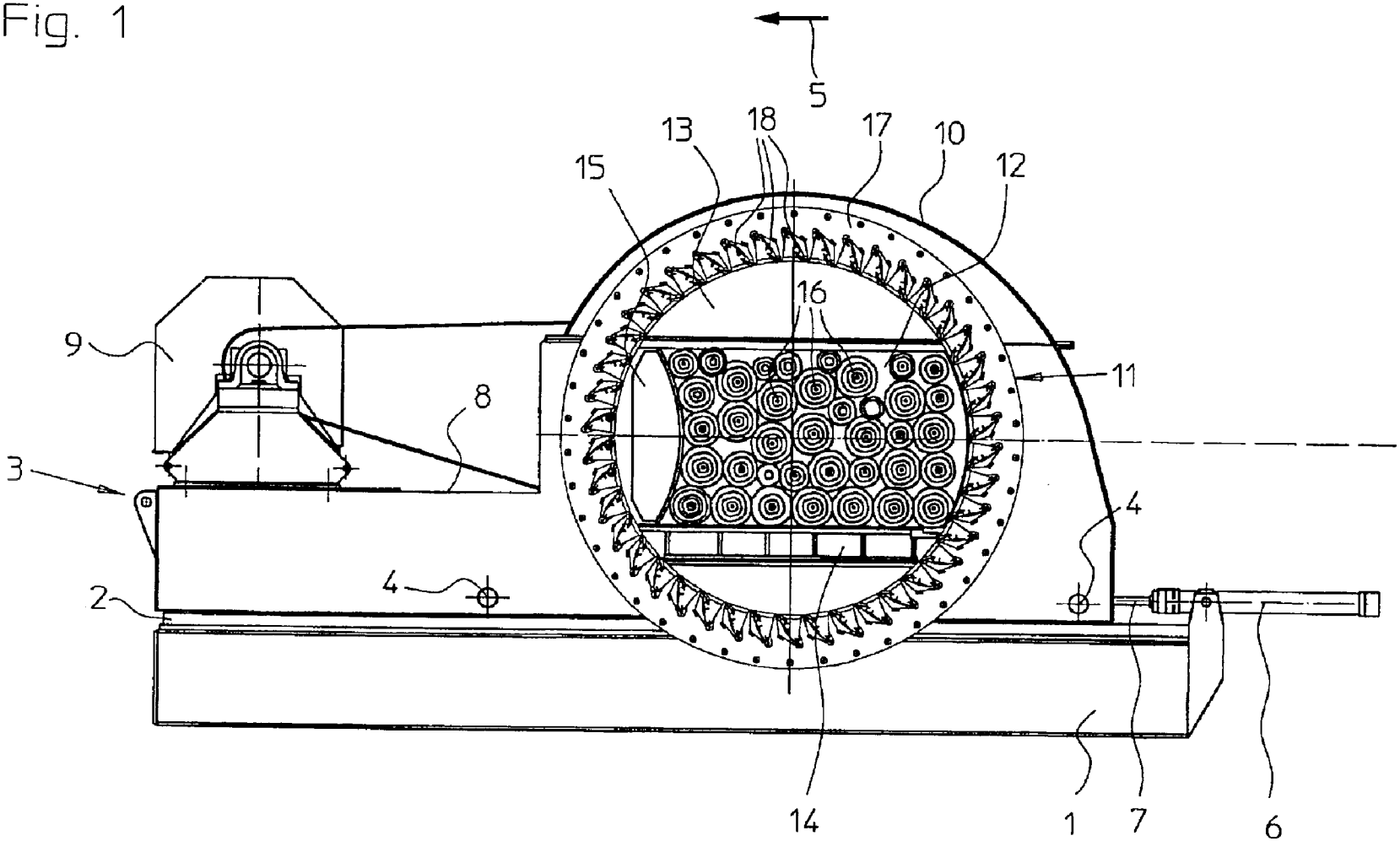
FIG. 1 shows a vertical longitudinal section of a slicing device for long-cut wood with rotating knife block.

FIG. 1 illustrates a vertical longitudinal section of a long-cut wood slicing device. Shown is a stationary substructure 1 having at its top side rails 2 extending within the plane of the illustration. The rails 2 serve as a running path for the basic frame 3 of the machine which is configured to be transversely movable on wheels 4 in the direction of arrow 5. Connected fixedly with the substructure 1 is a cylinder/piston unit 6 whose movable piston 7 acts on the basic frame 3 of the machine and thus ensures the transverse movement of the basic frame 3 of the machine. The basic frame 3 of the machine has moreover a platform 8 on which an electric motor 9 is supported.

Also, a hood-shaped housing 10 is mounted on the machine frame 3 which serves for receiving a knife block 11 freely rotatable about a horizontal axis. While the back wall of the housing 10 is closed and provided for supporting the drive shaft of the knife block 11, the front side of the housing 10 has a circular opening through which the comminution chamber 12 is freely accessible. The comminution chamber 12 is limited in the upward direction by a circular arc segment 13 whose curved side extends at a minimal spacing relative to the knife block 11. In the lower area a bottom configuration 14 delimits the comminution chamber 12 and is stationarily connected to the housing 10, as is the circular arc segment 13. The left boundary surface of the comminution chamber 12, in the plane of the illustration, is formed by an abutment 15 projecting axially into the comminution chamber 12 and having a convex shape in cross-section which is arranged stationarily relative to the substructure 1 of the machine and thus does not follow the transverse movement of the base frame 3 of the machine. The opposite side of the comminution chamber 12 is formed by the inner side of the knife block 11 and forms at the same time the comminution path.

The material to be comminuted in the form of tree trunks 16, like the abutment 15, projects with the free portion of its length axially into the comminution chamber 12. The parts of the tree trunks 16 positioned outside of the comminution chamber 12 are located within a non-illustrated feeding device at whose end they are fixedly clamped for the slicing process. In addition, holding-down devices (not illustrated) are present with in the comminution chamber 12 which secure the tree trunks 16 in the comminution chamber 12 during the slicing process.

The comminution of the tree trunks 16 is realized by transverse movement of the basic frame 3 of the machine while the knife block 11 rotates; as a result of the stationary abutment 15 the tree trunks 16 are forced against the comminution path and are thus brought into engagement with the comminution tools.

Figure 2:
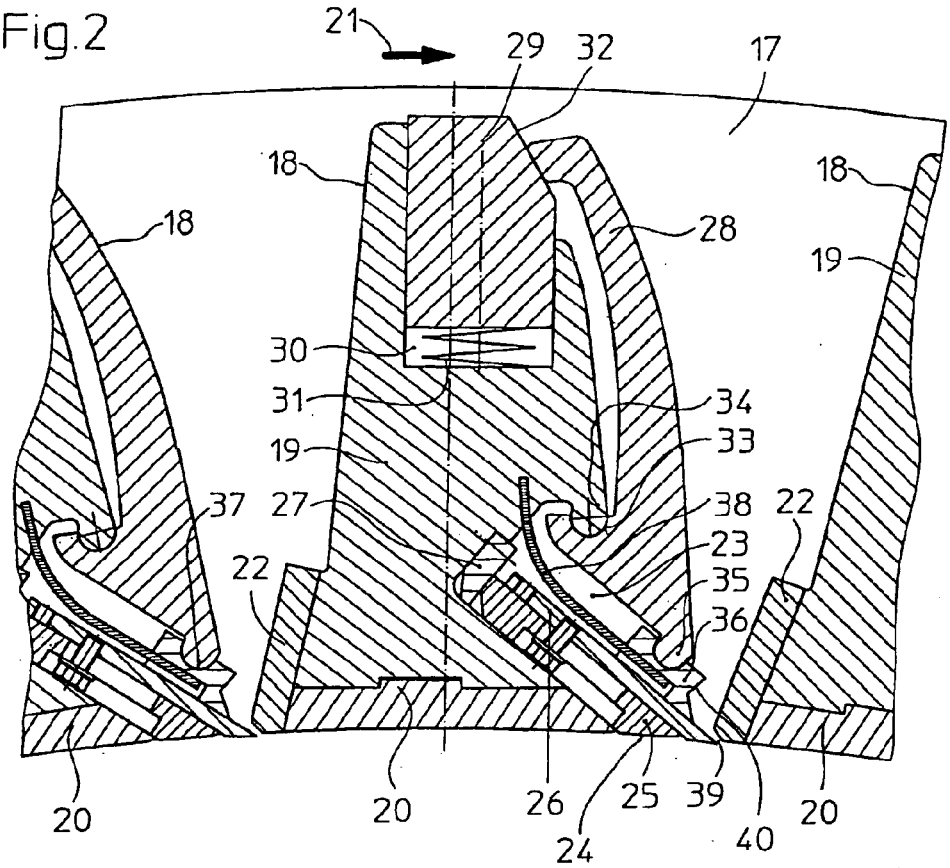
FIG. 2 shows a partial section of the knife block according to the invention.

The knife block 11 is comprised of two annular discs arranged concentrically and at a spacing to one another of which in FIGS. 1 and 2 only the rearward annular disc can be seen (identified by 17) as a result of the placement of the section plane used for the illustration. The inner sides of the two annular discs 17 are connected by axially aligned knife carriers 18 which are uniformly distributed about the circumference so that an inherently stiff knife block 2 results.

The precise arrangement of the knife carriers 18 relative to one another and relative to the annular discs 17 as well as the detailed configuration of the knife carriers 18 can be taken from FIG. 2.

FIG. 2 shows a section of a knife block according to the invention. The reference numeral 17 identifies the annular disc at the side of the hub whose inner side projects perpendicularly to the knife carriers 18. The knife carriers 18 are comprised substantially of a basic support 19 which is provided on the side facing the comminution chamber 12 with a wear shoe 20. Each wear shoe 20 has correlated therewith a pressure lip 22 at its rearward end in the circumferential direction 21.

Each knife carrier 18 has at its leading side in its circumferential direction 21 a recess 23 opening at a slant into the comminution chamber 12. The recess 23 is provided for receiving a knife unit 24. The knife unit 24 is comprised of a securing plate 25 on which the slicing knife 26 is adjustably fastened. Upon insertion of the knife unit 24 into the recess 23, the rearward longitudinal edge of the knife unit 24 rests against the stop strip 27 which forms a stationary reference surface for ensuring the required projecting length of the cutting edge.

For fastening the knife unit 24 in the recess 23, a positive-locking clamping action is generated by means of a pressure flap 28. The clamping force exerted by the pressure flap 28 onto the knife unit 24 is generated by a strip-shaped centrifugal wedge 29 which extends almost across the entire axial length of the basic support 19 and is radially moveably guided in a guide groove 30 provided in the basic support 19 which has parallel sidewalls. Between the bottom of the guide groove 30 and the centrifugal wedge 29 a pressure spring 31 is mounted whose spring force moves the centrifugal wedge 29 permanently outwardly.

Outside of the guide groove 30 the centrifugal wedge 29 has a wedge surface 32 on one side on which the pressure flap 28 rests with a matching gliding surface. The pressure flap 28 is provided at its inner side with a recessed groove 33 which is engaged by a hinge strip 34 mounted on the basic carrier 19. At the upper end of the pressure flap 28 a further hinge strip 35 is formed which forms a pivot joint, together with a recessed groove 38 provided on the top side of a clamping strip 36. The bottom side of the clamping strip 36 rests areally on the back of the slicing knife 26. A leaf spring 38, clamped in the recess 23 in the basic support 19, pretensions the clamping strip 36 against the slicing knife 26.

The back of the slicing knife 26 of each knife carrier 18 forms a passage slot in the form of a guide channel 39 together with the pressure lip 22 of a leading knife carrier 18 in the circumferential direction 21. The guide channel 39 ensures by means of its longitudinal sides formed by the knife back and the pressure lip 22 that a strand which is being produced is secured even behind the cutting edge of the slicing knife 26. As a result of the two-sided securing action of the strand to be produced before as well as behind the cutting edge of the slicing knife 26 the cutting process is significantly improved and, in this way, the quality of the produced strands is increased.

The longitudinal sides of the guide channel 39 form an angle $\alpha$. The guide channel 39 has a smallest width B, and a depth T in the direction of travel of the material comminuted by the knives.

The strand which is removed via the guide channel 39 is aligned as a result of the three-dimensional configuration of the guide channel in a directed way onto the end face 40 of the clamping strip 36. The end face 40 is formed as a breaker strip for generating a uniform strand width. The breaker strip deflects the strand to such a degree that it surpasses the elastic bending limit of the strand. The strands generated in this way have a width which corresponds to the spacing of the end face 40 of the clamping strip 36 to the cutting edge of the slicing knife 26.

Figure 3:
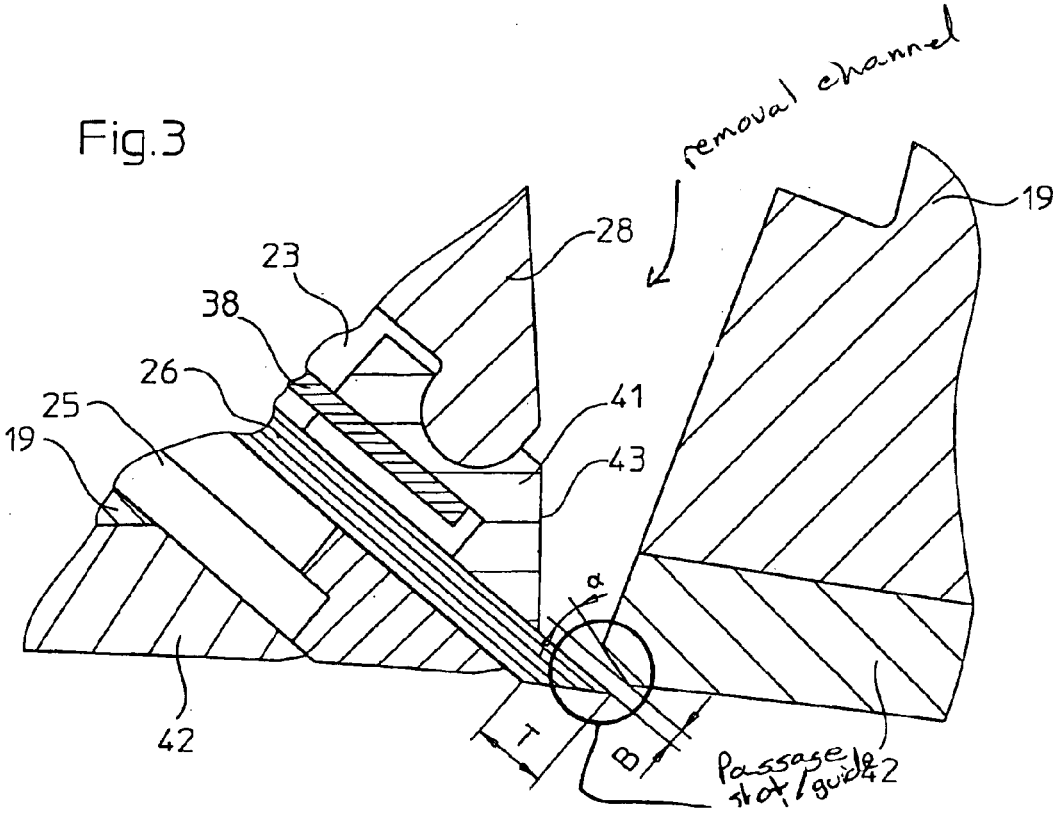
FIG. 3 shows a partial section of a further embodiment of the invention.

The detail of two knife carriers illustrated in FIG. 3 corresponds substantially to the knife carriers described in connection with FIG. 2 so that for same components the same reference numerals are used. The knife carrier 18 illustrated in FIG. 3 differs only in the configuration of the clamping strip 41 as well as of the wear shoe 42. The clamping strip 41 has a guide surface 43 at an end face where the strand being removed is not broken so that in this way a maximum strand width results. Moreover, the wear shoe 42 extends to the rearward edge of the knife carrier 18 in the circumferential direction 21 so that the guide channel 39 in this case is formed by the back of the slicing knife 26 and the edge of the wear shoe 42 which is chamfered for this purpose.

The gist of the invention is not limited to the illustrated embodiment of a rotating knife block which can be moved by a lateral movement into engagement with the material to be comminuted which arrangement describes only one exemplary embodiment of the invention. The invention includes also stationary or rotating knife blocks which cooperate with an inwardly positioned rotating beater wheel system as well as disc comminuting devices in which the knife carriers are positioned radially in a comminution plane and define a ring-shaped comminution path.

While specific embodiments of the invention have been shown and described in detail to illustrate the inventive principles, it will be understood that the invention may be embodied otherwise without departing from such principles.

What is claimed is:

1. A comminuting unit of a comminuting machine for comminuting material, the comminuting unit comprising:

a plurality of knife carriers having a longitudinal axis, respectively, wherein the knife carriers are arranged along a comminution path of the comminuting unit and have a leading longitudinal edge, respectively;

wherein the knife carriers are aligned with the longitudinal axes transversely to the comminution path and parallel to one another;

wherein the knife carriers have an axis-parallel slicing knife, respectively, arranged at the leading longitudinal edge;

wherein the slicing knives have a cutting edge, respectively, extending at a predetermined angle and with a predetermined projecting length into the comminution path;

wherein axial passage slots are formed between the knife carriers allowing passage of material comminuted by the slicing knives, wherein a rearward longitudinal edge of a preceding one of the knife carriers and the slicing knife of the following one of the knife carriers together define the axial passage slot, respectively, in the comminution path; and wherein the passage slots are in the form of a three-dimensional guide channel, respectively, in order to produce a three-dimensional holding of a strand in the region behind the cutting edge of the slicing knife, the guide channel having longitudinal sides widening in a direction of passage of the material comminuted by the slicing knife, the longitudinal sides defining an opening angle of maximally 20°.

2. The comminuting unit according to claim 1, wherein the opening angle is less than 5°.

3. The comminuting unit according to claim 1, wherein the guide channel has a smallest width between 1.5 mm and 3 mm.

4. The comminuting unit according to claim 3, wherein the smallest width is 2.3 mm.

5. The comminuting unit according to claim 1, wherein a depth of the guide channel in a direction of passage of the material comminuted by the slicing knives is 4 mm to 16 mm.

6. The comminuting unit according to claim 1, wherein the comminuting unit is configured as a knife block of a wood slicer.

7. A comminuting unit of a comminuting machine for comminuting material, the comminuting unit comprising:

a plurality of knife carriers having a longitudinal axis, respectively, wherein the knife carriers are arranged along a comminution path of the comminuting unit and have a leading longitudinal edge, respectively;

wherein the knife carriers are aligned with the longitudinal axes transversely to the comminution path and parallel to one another;

wherein the knife carriers have an axis-parallel slicing knife, respectively, arranged at the leading longitudinal edge;

wherein the slicing knives have a cutting edge, respectively, extending at a predetermined angle and with a predetermined projecting length into the comminution path;

wherein axial passage slots are formed between the knife carriers allowing passage of material comminuted by the slicing knives, wherein a rearward longitudinal edge of a preceding one of the knife carriers and the slicing knife of the following one of the knife carriers together define the axial passage slot, respectively, in the comminution path; and wherein the passage slots are in the form of a three-dimensional guide channel, respectively, in order to produce a three-dimensional holding of a strand in the region behind the cutting edge of the slicing knife, the guide channel having longitudinal sides defining an opening angle between 0° and 20°.

* * * * *